US007845631B2

(12) United States Patent
Wada et al.

(10) Patent No.: US 7,845,631 B2
(45) Date of Patent: Dec. 7, 2010

(54) TRANSPORTING DEVICE AND IMAGE FORMING APPARATUS

(75) Inventors: Hiroshi Wada, Nara (JP); Katsuhiro Yoshiuchi, Nara (JP)

(73) Assignee: Kyocera Mita Corporation, Osaka (JP)

( * ) Notice: Subject to any disclaimer, the term of this patent is extended or adjusted under 35 U.S.C. 154(b) by 279 days.

(21) Appl. No.: 11/653,291

(22) Filed: Jan. 16, 2007

(65) Prior Publication Data

US 2008/0029950 A1 Feb. 7, 2008

(30) Foreign Application Priority Data

Jan. 30, 2006 (JP) ..... 2006-020419

(51) Int. Cl.
*B65H 1/18* (2006.01)

(52) U.S. Cl. ..... 271/152; 271/153; 271/154; 271/155; 271/157

(58) Field of Classification Search ..... 271/152, 271/153, 154, 155, 157
See application file for complete search history.

(56) References Cited

U.S. PATENT DOCUMENTS

| | | | | |
|---|---|---|---|---|
| 5,379,995 | A * | 1/1995 | Endo | 271/9.01 |
| 5,451,039 | A * | 9/1995 | Adachi | 271/9.06 |
| 5,716,046 | A * | 2/1998 | Katamoto et al. | 271/3.08 |
| 6,068,187 | A * | 5/2000 | Momose | 235/449 |
| 2003/0085506 | A1 * | 5/2003 | Kubo | 271/117 |
| 2004/0212139 | A1 * | 10/2004 | Nagao et al. | 271/110 |
| 2005/0158076 | A1 * | 7/2005 | Pichlmeier et al. | 399/165 |
| 2005/0218588 | A1 * | 10/2005 | Ohtsuka et al. | 271/279 |
| 2006/0072948 | A1 * | 4/2006 | Miyake et al. | 399/361 |

FOREIGN PATENT DOCUMENTS

| | | | |
|---|---|---|---|
| JP | 03-288736 | A | 12/1991 |
| JP | 2000-053255 | A | 2/2000 |
| JP | 2000-095358 | A | 4/2000 |
| JP | 2000-095359 | A | 4/2000 |
| JP | 2000-219336 | A | 8/2000 |
| JP | 2001-096861 | A | 4/2001 |
| JP | 2002-119091 | A | 4/2002 |
| JP | 2003-118851 | A | 4/2003 |
| JP | 2005-187145 | A | 7/2005 |
| JP | 2005-247440 | A | 9/2005 |

OTHER PUBLICATIONS

Japanese Notice of Rejection of corresponding Japanese Application No. 2006-020419, dated Sep. 8, 2010.

* cited by examiner

*Primary Examiner*—Patrick Mackey
*Assistant Examiner*—Ernesto Suarez
(74) *Attorney, Agent, or Firm*—Global IP Counselors, LLP

(57) ABSTRACT

A transporting device moves sheet-like objects. The transporting device has an elevator plate mounted to be liftable and lowerable on a loading surface to load an object to be moved; a drive part to lift and to lower the elevator plate via gears; and a controller to execute a preparatory operation to operate the drive part in a direction only by a drive amount corresponding to the gear backlash during the time after the drive part has completed an elevator plate drive operation in one direction until the start of an elevator plate drive operation in another direction.

6 Claims, 10 Drawing Sheets

TRANSPORTING DEVICE AND IMAGE FORMING APPARATUS

CROSS-REFERENCE TO RELATED APPLICATIONS

This application claims priority to Japanese Patent Application No. 2006-020419 filed on Jan. 30, 2006. The entire disclosure of Japanese Patent Application No. 2006-020419 is hereby incorporated herein by reference.

BACKGROUND OF THE INVENTION

1. Field of the Invention

The present invention generally relates to a transporting device and image forming apparatus. More specifically, the present invention relates to a transporting device that transports a flat sheet type object such as a document and paper sheet or the like onto which a document image is to be transferred, and an image forming apparatus provided with the transporting device, and even more specifically relates to a transporting device having an elevator plate mounted on an object mounting surface to be liftable and lowerable, and an image forming apparatus.

2. Background Information

Image forming apparatuses such as copiers, facsimile machines, scanners, and multipurpose apparatuses are provided with document feeding devices. An image forming apparatus consecutively reads each document by automatically transporting a document having a plurality of sheets one by one to an image reading position using the document feeding device. The document feeding device receives a stack of document sheets so as to abut a pick-up roller in order to separate one sheet at a time from the multiple sheets of a document placed in a document tray. Since the thickness of the stack of document sheets changes according to the number of sheets of the document stacked in the document tray, the distance separating the pick-up roller and the document mounting surface must be adjusted in accordance with the thickness of the document stack to abut suitably the document stack. This adjustment is accomplished using the elevator plate mounted on the mounting surface of the document to be liftable and lowerable. The document stack on the elevator plate is raised so as to abut the pick-up roller when the elevator plate is actuated. For example, The elevator plate has a support shaft on the upstream side of the pick-up roller in the document transport direction, and the elevator plate is oscillated on this shaft via a motor. Thus, the leading edge of the uppermost sheet of the document abuts the pick-up roller and the pick-up roller feeds the document sheet.

The stopping position of the elevator plate when the document is being fed is detected by an upper limit position sensor (hereinafter referred to as "upper limit switch"). The upper limit switch detects whether or not the top surface of a document stack abuts the pick-up roller. For example, the stopping position can be detected by the upper limit switch detecting the position of the top surface of the document stack in a document feeding device that has a configuration in which the position of the pick-up roller is stationary. Furthermore, the stopping position can be detected by the upper limit switch detecting the position of the pick-up roller or a member that moves in linkage with the pick-up roller in a document feeding device provided with a mechanism lifting the pick-up roller together with the lifting of the elevator plate.

The thickness of the document stack decreases as the document feeding progresses. In the case of a document having many sheets, the pick-up roller may not feed the lower document sheets when the thickness of the document stack decreases. Therefore, when, for example, the thickness of a document stack is reduced below a standard amount in such a document feeding device, the elevator plate is actuated and the document stack is lifted. Thus, the top surface of the document stack is caused to abut suitably the pick-up roller, and table document feeding can be realized. The lifting of the elevator plate while a document is being fed is performed in concert with the change in the detection status of the upper limit switch described above.

When a document is loaded on the elevator plate, however, the elevator plate is disposed at a document loading position. The document loading position is at the lower limit of the elevator range of the elevator plate. The movement of the elevator plate to the document loading position is performed when an immediately previously performed document feeding has been completed. That is, the elevator plate is driven downward when a sensor for detecting the presence/absence of a document on the document tray enters the negative detection state, i.e., no document sheets present. The elevator plate is lowered until the elevator plate position is detected by a lower limit position sensor (hereinafter referred to as "lower limit switch") provided at a position opposing the bottom surface of the elevator plate as having reached the lower limit.

In the document feeding device provided with an elevator plate described above, the amount of movement of the elevator plate is measured to detect the abnormal raising and lowering of the elevator plate. For example, when a stepping motor is used as a lift motor for lifting the elevator plate, the amount of movement of the elevator plate can be measured by counting the number of drive pulses that drive the lift motor, for example, as shown in Japanese Laid-Open Patent Publication Nos. 2000-53255, 2000-95358, and 2005-187145.

When a document stack which is near the upper limit capacity of the document tray is loaded on the elevator plate in the document feeding device mentioned above, the pick-up roller abuts the top surface of the document stack the moment the document has been loaded. At this time, document feeding can begin under the existing condition without driving the elevator plate since there is no need to raise the document stack. When the thickness of the document stack decreases as the document feeding progresses, the elevator plate is lifted to raise the document stack as previously described.

The lifting of the elevator plate while a document is being fed in the manner mentioned above is performed in concert with the change in the detection status of the upper limit switch. That is, the upper limit switch is set to the detection state (ON condition) when the top surface of the document stack abuts the pick-up roller, and the upper limit switch is set to the negative detection state (OFF condition) when the thickness of the document stack is reduced a predetermined amount. The lifting of the elevator plate starts in conjunction with these states such that the elevator plate is lifted until the upper limit switch is turned ON. At this time, the necessary amount of elevation is the amount of decrease in the document stack, and may be a fixed amount unrelated to the thickness of the document stack. However, while this same document stack is being fed, the first lifting operation of the elevator plate requires more time than the second and subsequent lifting operations of the elevator plate despite the fact being lifted a fixed amount. This phenomenon is undesirable inasmuch as processing performance is reduced. In addition, when an abnormal lift is detected as an amount of movement that exceeds an amount of a slight surplus added to the fixed amount, the document feeding device detects an abnormal lift since a greater number of drive pulses are input in the first lifting operation of the elevator plate compared to the second and subsequent lifting operations. Conversely, when the first lifting operation of the elevator plate is set as a normal lift, an abnormal lift generated in the second or subsequent lifts cannot be detected.

The lifting of the elevator plate while a document is being fed is changed by the detection via the upper limit switch, and can be realized, for example, by inputting a drive pulse to drive the lift motor a fixed amount. However, in this configuration the amount by which the elevator plate is lifted the first time is less than the amount by which the elevator plate is lifted the second and subsequent times. In this case, the elevator plate is not lifted a desired amount during the first lifting operation, and the top surface of the document stack does not suitably abut the pick-up roller. Therefore, more time may be required for a retry process, or a feed error may occur.

In view of the above, it will be apparent to those skilled in the art from this disclosure that there exists a need for an improved transporting device and image forming apparatus. This invention addresses this need in the art as well as other needs, which will become apparent to those skilled in the art from this disclosure.

SUMMARY OF THE INVENTION

In view of the problems of the conventional art described above, an object of the present invention is to provide an image forming apparatus and transporting device capable of reliably transporting an object in a short time even when a transport object having upper limit capacity is loaded on the elevator plate.

The present inventors have discovered through analysis of the above described phenomenon that the cause lies in a backlash in the gears, i.e. the space between the thickness of a gear tooth or teeth and the width of the space between teeth in the mating gear, that drive the elevator plate caused by the loading of the document stack. In the case in which the upper limit switch is turned ON at the moment a document stack is loaded in the document tray, the lifting of the elevator plate begins when the document stack has been loaded and the document feeding has progressed such that the number of document sheets has decreased. That is, the drive of the elevator plate immediately before the lifting operation is a lowering drive to move to the document loading position. In an operation to reverse this drive direction, the drive force can not be transmitted until the gear backlash has dissipated even though the lift motor is actuated. Thus, the phenomenon described above is generated.

The above mentioned object and other objects are attained by the transporting device of the present invention by providing a transporting device that moves sheet-like objects having an elevator plate mounted to be liftable and lowerable on a loading surface to load an object to be moved; a drive part that lifts the elevator plate via gears; and a controller that executes a preparatory operation to operate the drive part in a direction only by a drive amount corresponding to the gear backlash during the time after the drive part has completed an elevator plate drive operation in one direction until the start of an elevator plate drive operation in another direction. Furthermore, the image forming apparatus of the present invention is provided with this transporting device.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents. The embodiment of the transporting device described below is an example of a document feeder for transporting documents.

First Embodiment

Figure 1:
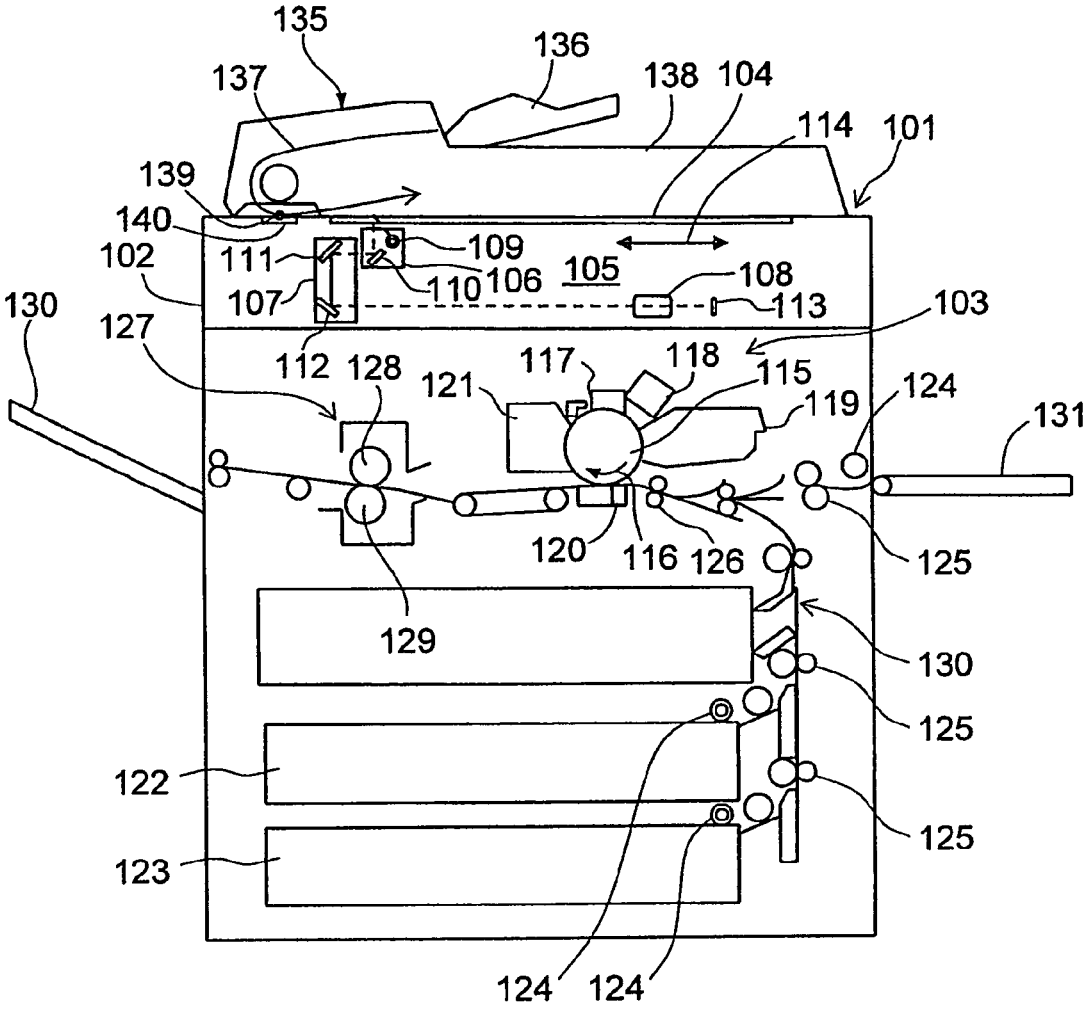
FIG. 1 is a schematic cross-sectional view showing the general structure of a copier in accordance with a first preferred embodiment of the present invention.

FIG. 1 is a schematic cross-sectional view of the general structure of a copier in accordance with a first preferred embodiment of the present invention. As shown in FIG. 1, a copier 101 is provided with an image reading part 102 and an image forming part 103. The image reading part 102 reads the image of a document and generates digital data of the image. The image reading part 102 has a document platen 104, which is preferably configured by a transparent plate such as contact glass or like, on the top surface of a casing. A document can be loaded on the document platen 104. A scanning optical system 105 is disposed below the document platen 104. The scanning optical system 105 is provided with a first carriage 106, second carriage 107, and collective lens 108. The first carriage 106 is provided with a linear light source 109 and a mirror 110, and the second carriage 107 is provided with mirrors 111 and 112. The light source 109 illuminates the document. The mirrors 110, 111, and 112 direct the light reflected from the document to the lens 108. The lens 108 forms an optical image on the photoreceptive surface of line image sensor 113. In the scanning optical system 105, the first carriage 106 and the second carriage 107 are provided to move reciprocatingly in a sub scanning direction 114. The image of a document loaded on the document platen 104 can be read by the image sensor 113 by moving the first carriage 106 and the second carriage 107 in the sub scanning direction 114. The image sensor 113 generates image data of the document from the optical image formed on the photoreceptive surface.

The image forming part 103 prints image data obtained by the image reading part 102, and image data received from another device over a network via a network adapter or the like not shown in the drawing. The image forming part 103 is provided with a photosensitive drum 115. The photosensitive drum 115 rotates at a constant speed in the arrow direction 116. Disposed sequentially around the periphery of the photosensitive drum 115 in the direction of rotation are a charging unit 117, optical exposure unit 118, developing unit 119, transfer unit 120, and cleaning unit 121. The charging unit 117 uniformly charges the surface of the photosensitive drum 115. The optical exposure unit 118 irradiates the uniformly charged surface of the photosensitive drum 115 with light corresponding to the image data to form an electrostatic latent image on the photosensitive drum 115. The developing unit 119 adheres toner to the electrostatic latent image to form a toner image on the photosensitive drum 115. The transfer unit 120 transfers the toner image on the photosensitive drum 115 onto a paper sheet. The cleaning unit 121 removes the waste toner remaining on the surface of the photosensitive drum 115 from the photosensitive drum 115, to clean the surface of the photosensitive drum 115. These processes are performed consecutively via the rotation of the photosensitive drum 115.

The image forming part 103 supplies a sheet from a manual tray 131, or paper cassettes 122 or 123 or the like to a transfer area between the photosensitive drum 115 and the transfer unit 120. Sheets of various sizes can be loaded or accommodated in the manual tray 131, and paper cassettes 122 and 123. The image forming part 103 selects a sheet specified by a user or a sheet in accordance with the automatically detected document size, and pulls the selected sheet from the manual tray 131, or cassettes 122 and 123 via a feed roller 124. The pulled sheet is delivered to the transfer area via a transport roller 125 and resist roller 126. The sheet bearing the transferred toner image is transported to a fixing unit 127. The fixing unit 127 has a fixing roller 128 and a pressure roller 129, and fixes the toner image to the sheet via heat and pressure. The image forming part 103 discharges the sheet that has passed through the fixing unit 127 onto a discharge tray 130.

In this type of copier 101, a document feeder 135 (transporting device) can be mounted to open and to close on the top side of the image forming part 102. The document feeder 135 is provided with a document tray 136, transport path 137, and discharge tray 138. A user loads a document on the document platen 104, or places a document (sheet-like object) on the document feeder 135. The document feeder 135 transports the document placed on the document tray 136 one sheet at a time to the transport path 137. An image reading position 139 is on the transport path 137. A reading glass 140 is also provided at the image reading position 139 and not just on the top surface of the casing of the image reading part 102. When reading the image of a document placed on the document feeder 135, the image reading part 102 aligns the first carriage 106 and second carriage 107 at the image reading position 139 and temporarily holds them stationary. When the document passes through the image reading position 139, the document passes past the reading glass 140 and is irradiated and the image of the document is read. A document that has passed the image reading position 139 is discharged to the discharge tray 138.

Figure 2:
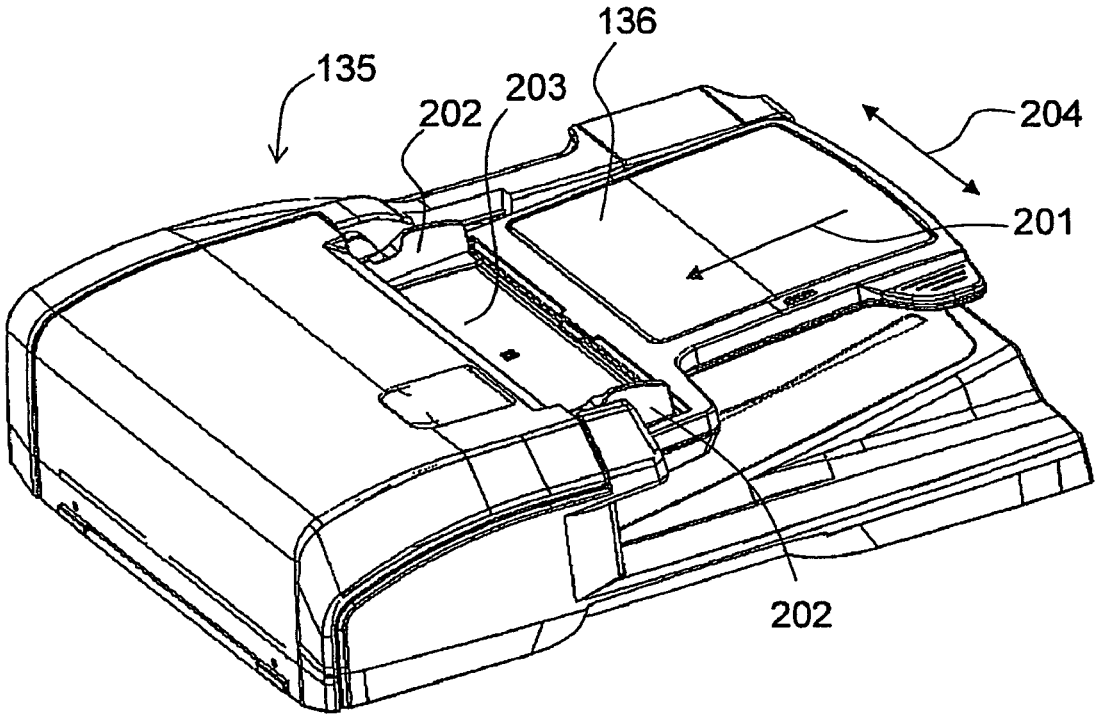
FIG. 2 is a perspective view showing the exterior of a document feeding device of the first preferred embodiment of the present invention.

FIG. 2 is a perspective view showing the exterior of the document feeder. In the document feeder 135, an elevator plate 203 provided with a document cursor 202 is mounted to be liftable and lowerable on the downstream side of the document tray 136 in the document transport direction 201. Below, the phrases "lift and lower" and "up and down" indicate the vertical directions in the orientation of the installed copier 101. That is, the side on which a document is loaded in the document tray 136 is the top surface. The document cursor 202 is provided to be capable of moving back and forth in a first direction 204, hereinafter the document width direction 204. It should be apparent from this disclosure that the document width direction 204 can also be the length direction of the document depending upon how the user orients the document on the document feeder 135. The center of a document in the width or length direction can be aligned with the machine by adjusting the width of the document loaded in the document tray 136 using the document cursor 202. The elevator plate 203 forms a document loading surface together with the document tray 136, and the leading edge of a document is lifted to feed a document one sheet at a time from the document stack placed on the loading surface to the transport path 137.

Figure 3:
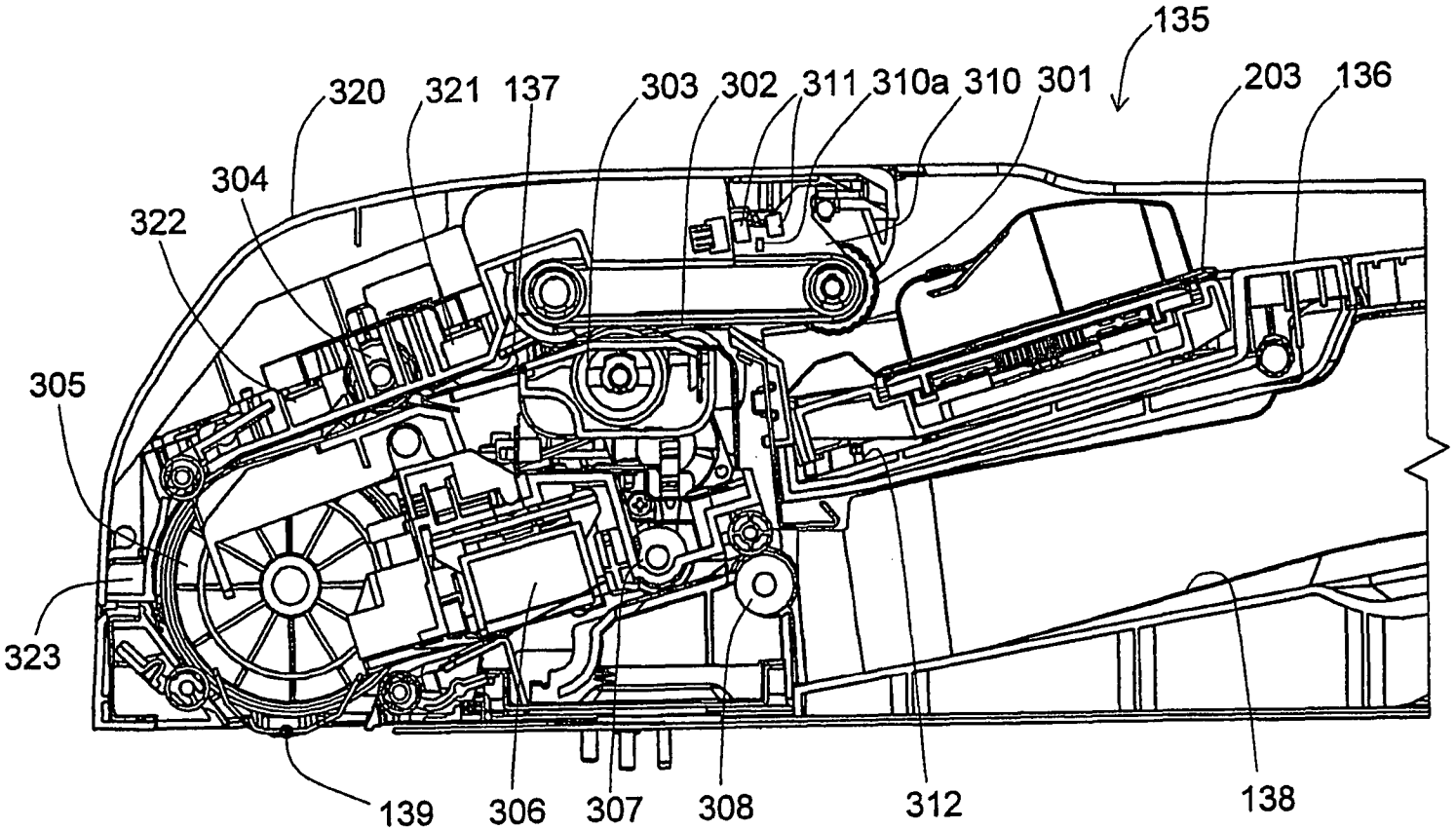
FIG. 3 is a cross-sectional view showing the structure of the document feeding device of the first preferred embodiment of the present invention.

FIG. 3 is a cross-sectional view showing details of the general structure of the document feeder 135. The document feeder 135 is provided with a pick-up roller 301, feed belt 302, and separating roller 303 to separate a document one sheet at a time from the document stack loaded in the document tray 136. When the elevator plate 203 is lifted, the leading edge of the uppermost sheet of the document stack is pushed against the pick-up roller 301.

The pick-up roller 301 is supported on a supporting case 310 that is rotatable in the document transport direction. The supporting case 310 is oscillatably supported, for example, on the top cover 320 so that the pick-up roller 301 is upwardly movable. An upper limit switch (appropriate position sensing part, upper limit position sensor) 311 is disposed on the top cover 320 to detect the presence of the elevator plate 203 at an appropriate position. The upper limit switch 311 is configured by, for example, a transparent photointerrupter. The supporting case 310 is provided with a protection **310*a* to block light that arrives at the photointerrupter when the uppermost sheet of a document is present at an appropriate position in the transport path. According to this configuration when the document stack loaded on the elevator plate 203 abuts the pick-up roller 301, the pick-up roller 301 moves upward in conjunction with the lifting of the elevator plate 203. When the projection 310*a* has arrived at the upper limit switch 311, the lifting of the elevator plate 203** is stopped. This position is referred to below as the appropriate transport position.

In this condition, a sheet of the document is preferably pulled from the document stack by driving the pick-up roller 301. Even when two or more sheets of a document are pulled, the first document sheet is separated from the rest of the document by the feed roller 302 and separating roller 303, and transported to the downstream side of the transport path 137. A resist roller 304 and transport roller 305 are provided downstream. The transport timing to the image reading position 139 is adjusted by the resist roller 304, and the transport roller 305 transports the document sheets to the image reading position 139. The image of one side of the document sheets is read at the image reading position 139. In the document feeder 135, a document reading position 306 that uses a contact optical system is disposed downstream from the image reading position 139. When reading images from both sides of a document sheet, the image of the remaining side is read at the image reading position 306. A document sheet that has passed the document reading position 306 is transported to the discharge roller 308 by the intermediate roller 307, and then is ejected to the discharge tray 138 by the discharge roller 308.

A feed switch 321 configured by a reflective-type photo-interrupter or the like is disposed on the wall of the transport path 137 near the downstream side of the separating roller 303. A resist switch 322 configured by a reflective-type photointerrupter of the like is disposed on the wall of the transport path 137 near the downstream side of the resist roller 304. Furthermore, a timing switch 323 configured by a reflective-type photointerrupter or the like is disposed on the wall of the transport path 137 between the resist switch 322 and the image reading position 139. It is possible to detect whether or not a document has been properly transported through the transport path 137 by monitoring the timing to detect the presence of document sheets via the feed switch 321, resist switch 322, and timing switch 323.

The elevator plate 203 is lowered when the last document sheet on the document tray 136 is fed. A lower limit switch 312 configured by a transmission-type photointerrupter is disposed at a position opposing the back surface of the elevator plate 203 on a square frame 403 (refer to FIG. 4) to install the elevator plate 203. A projection not shown in the drawing is provided on the back surface of the elevator plate 203 corresponding to the lower limit switch 312. The lowering of the elevator plate 203 is stopped when the projection on the back surface of the elevator plate 203 reaches the lower limit switch 312. This position is referred to as the document loading position (object loading position). That is, in the present embodiment, the position at which a signal from the lower limit switch 312 is detected when the projection on the back side of the elevator plate 203 reaches the lower limit switch 312 is the appropriate document loading position.

Figure 4:
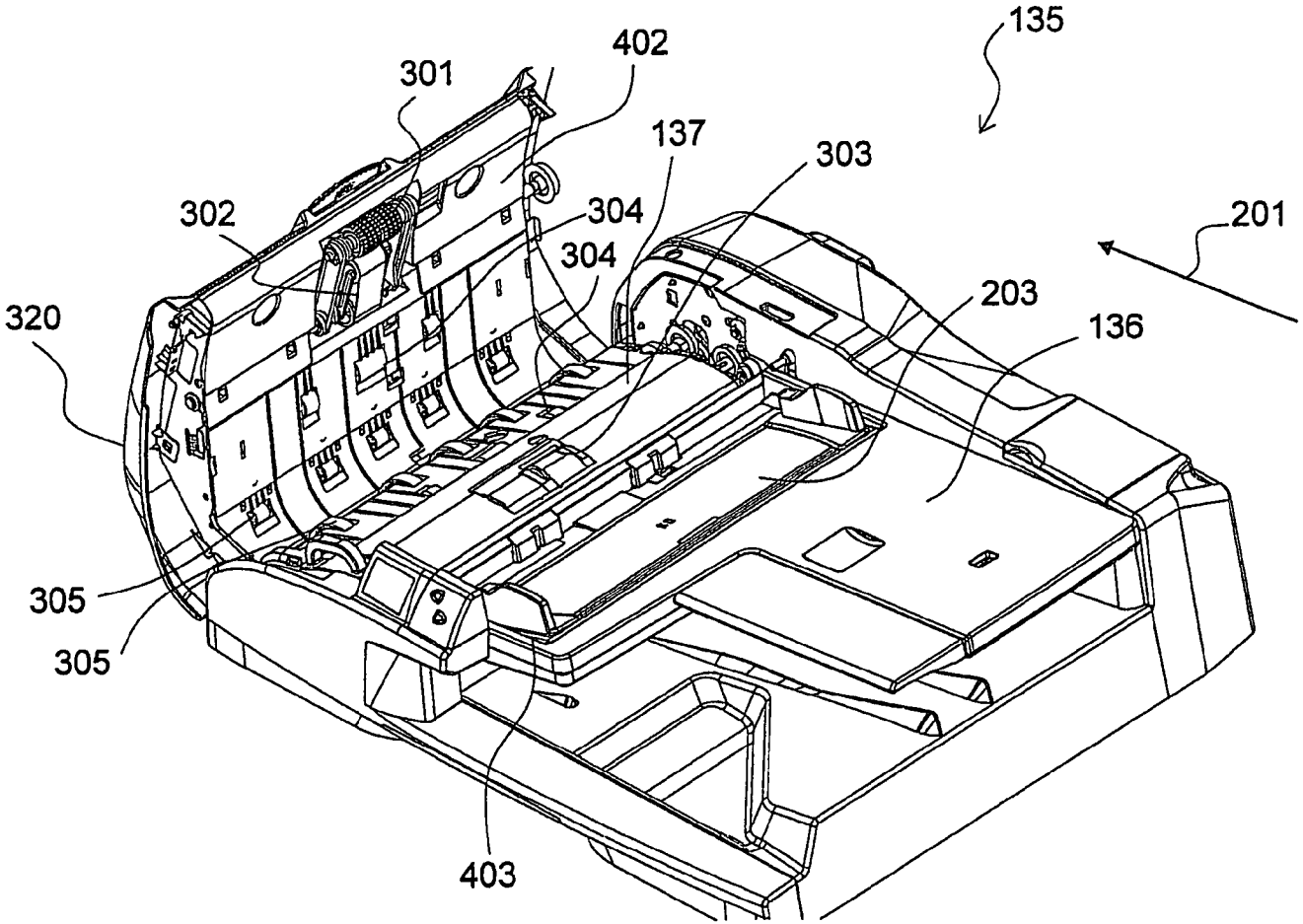
FIG. 4 is a perspective view showing the document feeding device of the first preferred embodiment of the present invention with an opened top cover.

FIG. 4 shows a top cover 320 open on the document feeder 135. The document feeder 135 is provided with the top cover 320 mounted to be capable of opening and closing, preferably by pivoting on an axis perpendicular to the document transport direction 201. The transport path 137 is exposed by opening the top cover 320. When a document sheet or sheets become jammed in the transport path 137, the top cover 320 is opened to remove the jammed sheet or sheets. An inner surface plate 402 of the top cover 320 forms the top surface of the transport path 137. A pick-up roller 301 and feed roller 302 are disposed on the inner surface plate 402. Furthermore, at least one roller among a pair of resist rollers 304 and a pair of transport rollers 305 is disposed on the surface plate 402. The other resist roller or rollers 304 and transport roller or rollers 305, and a separating roller 303 are provided on the main body side. When the top cover 320 is closed, the pick-up roller 301 faces the elevator plate 203 on the downstream side of the elevator plate 203 in the document transport direction 201. The elevator plate 203 fits into a square frame 403 provided on the document tray 136. In the document feeder 135, the elevator plate 203 is oscillatable in vertical directions about a shaft provided on the upstream side of the elevator plate 203 in the document transport direction 201.

Figure 5:
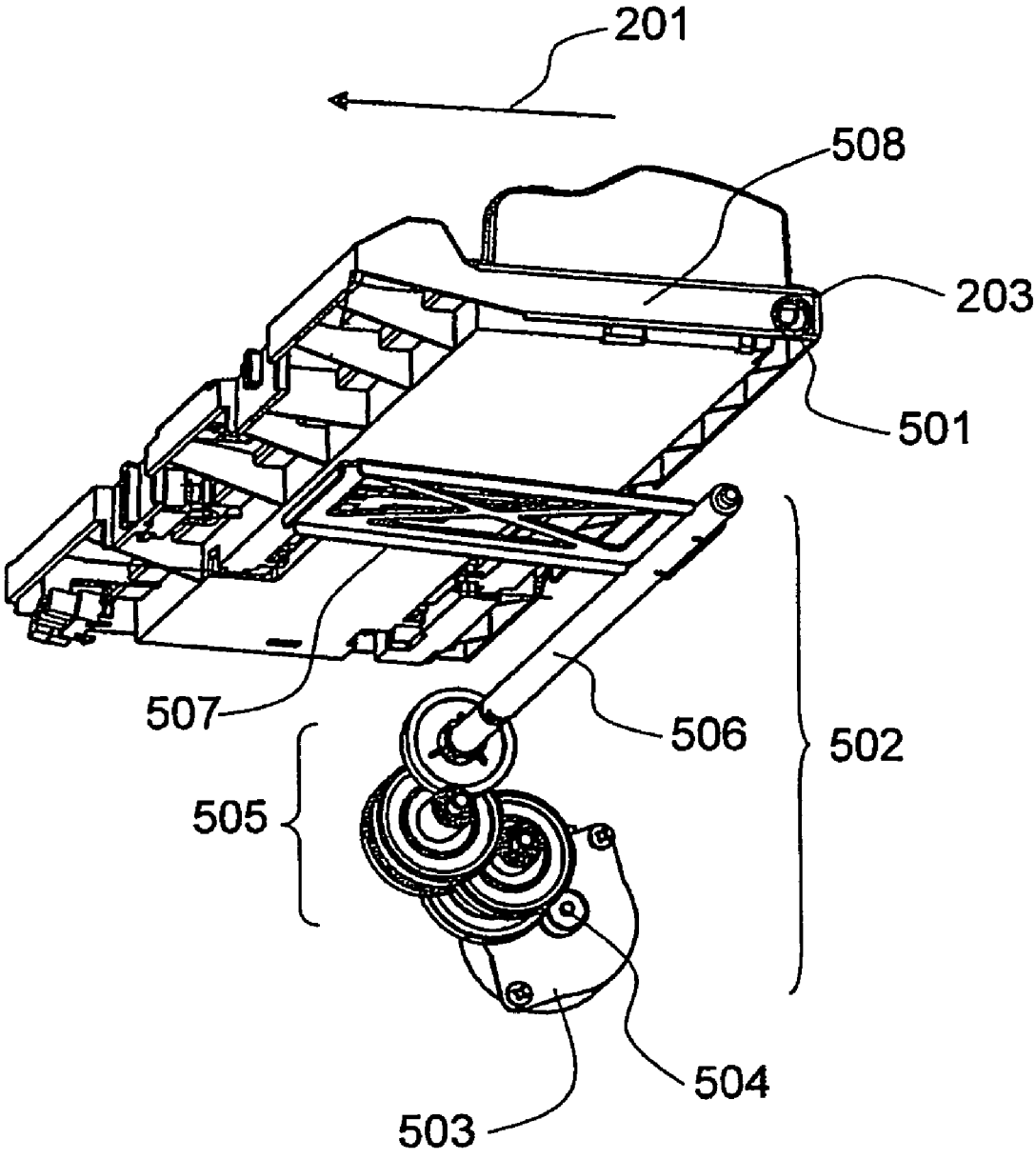
FIG. 5 is a perspective view showing the drive mechanism of an elevator plate of the document feeding device of the first preferred embodiment of the present invention.

FIG. 5 is a perspective view showing the drive mechanism of the elevator plate 203. The elevator plate 203 has an insertion hole 501 to insert the oscillating shaft on the upstream side of the side surface in the document transport direction 201. A drive mechanism (drive part) 502 to oscillate the elevator plate 203 is disposed on the bottom side of the elevator plate 203. The drive mechanism 502 is provided with a lift motor 503 configured by a stepping motor. The rotating shaft 504 of the lift motor 503 is linked to the drive shaft 506 via the gear assembly 505. A support plate 507 that supports the elevator plate 203 is integratedly mounted on the drive shaft 506. When the drive shaft 506 rotates, the downstream side of the elevator plate 203 in the document transport direction supported by the support 507 is raised.

Figure 6:
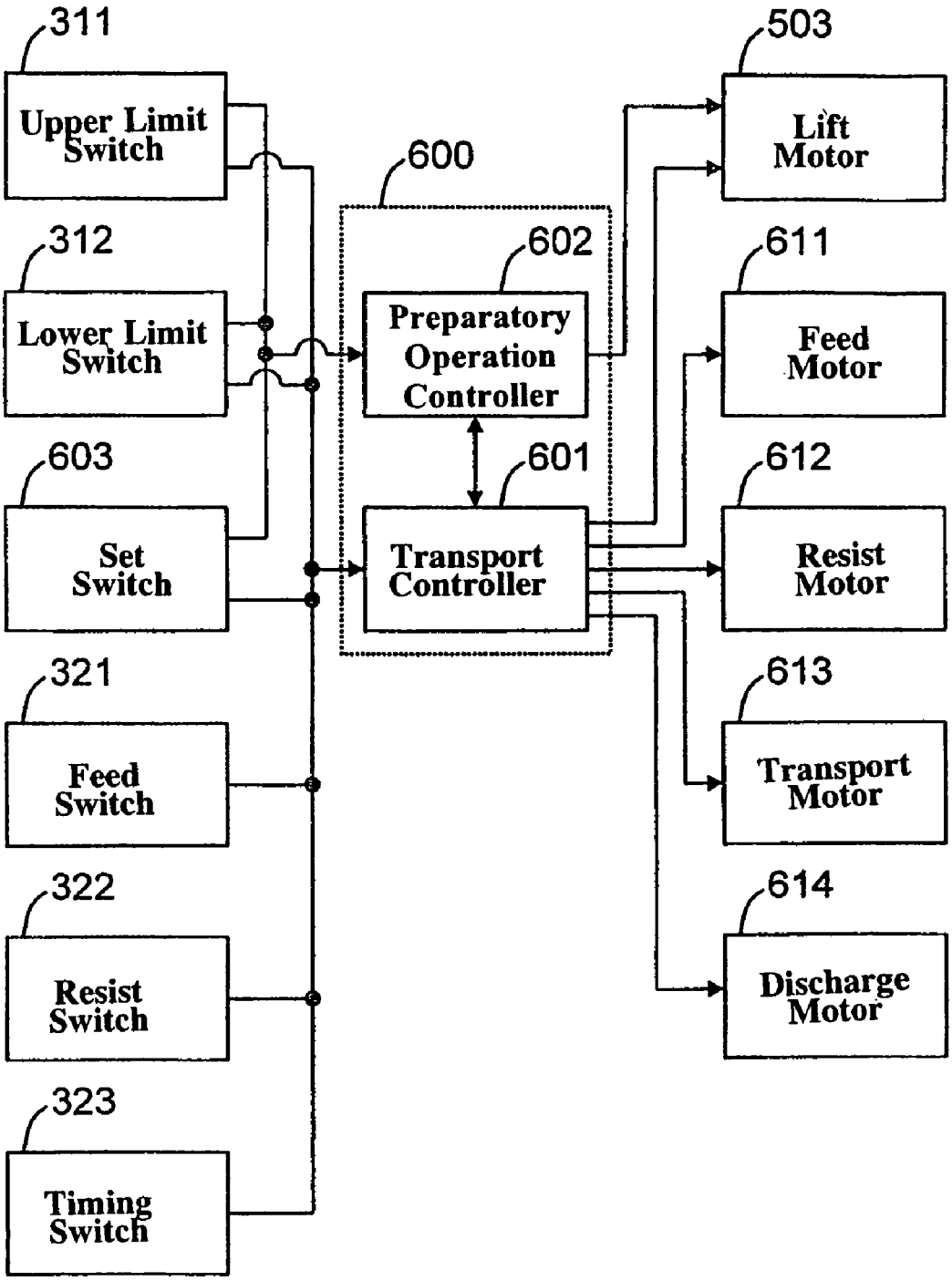
FIG. 6 is a view of a block diagram showing the controller of the document feeding device of the first preferred embodiment of the present invention.
Figure 7:
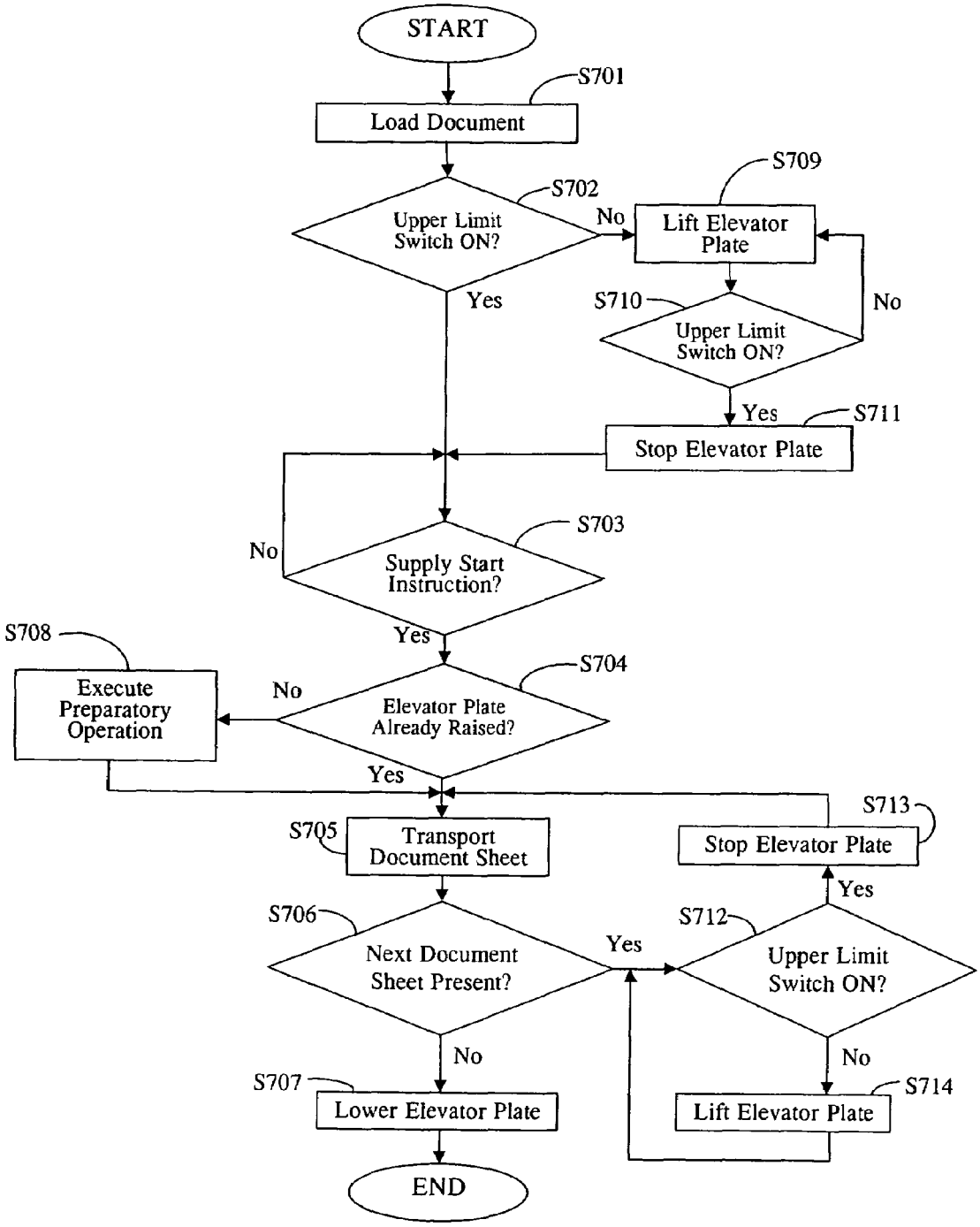
FIG. 7 is a view of a flow chart showing the process of the document feeding device of the first embodiment of the present invention.

FIG. 6 is a view of a function block diagram showing the control unit of the document feeder 135 having the structure described above. FIG. 7 is a view of a flow chart showing the process when a document stack is loaded in the document feeder 135. As shown in FIG. 6, the control unit 600 is provided with a transport controller 601 and a preparatory operation controller 602. The control unit 600 is configured by, for example, hardware provided with a memory such as a special operation circuit, processor, RAM, ROM or the like, and software or the like that operates on a processor, and is stored in the memory.

Referring now to FIGS. 3 and 6, the transport controller 601 is connected to the lift motor 503, feed motor 611, resist motor 612, transport motor 613, and discharge motor 614, and independently controls each motor. The feed motor 611 drives the separating roller 303 in rotation via a feed belt 302, and drives the pick-up roller 301 in rotation. The resist motor 612 rotates the resist roller 304. The transport motor 613 rotates the transport roller 305. The discharge motor 614 rotates the intermediate transport roller 307 and the discharge roller 308. The feed motor 611, resist motor 612, transport motor 613, and discharge motor 614 are configured by stepping motors identical or similar to the lift motor 503.

The output signals of the previously described upper limit switch 311, lower limit switch 312, feed switch 321, resist switch 322, timing switch 323, and a set switch 603 are input to the transport controller 601. The set switch 603 is a sensor that detects the presence of a document on the document tray 136, and is an example of the object detection part. The transport controller 601 outputs drive signals to the lift motor 503, feed motor 611, resist motor 612, transport motor 613, and discharge motor 614 based on the output signals.

The output signals of the set switch 603, upper limit switch 311, and lower limit switch 312 are also input to the preparatory operation controller 602. The preparatory operation controller 602 is connected to the lift motor 503, and outputs to the lift motor 503 control signals to drive only an amount corresponding to the backlash of the gear assembly 505 (refer to FIG. 5) based on these output signals. The drive amount corresponding to the backlash is determined experimentally beforehand, and set in the preparatory operation controller 602. When the lift motor 503 is a stepping motor, this drive amount can be set, for example, as the number of drive pulses of the lift motor 503.

As shown in FIGS. 3, 6, and 7, when a document stack is placed on the document tray 136, the set switch 603 changes, for example, from OFF status to ON status and the document stack is detected (step S701 in FIG. 7). In conjunction with the change of status of the set switch 603, the transport controller 601 determines whether or not the upper limit switch 311 has detected the raise of the pick-up roller 301 in this case, detected ON status (S702 in FIG. 7). When the upper limit switch 311 is turned OFF, the transport controller 601 outputs a control signal specifying lifting to the lift motor 503. Thus, the elevator plate 203 is lifted (S702 to S709 in FIG. 7). When the pick-up roller 301 abuts and is lifted by the top surface of the document stack during the rise of the elevator plate 203, the upper limit switch 311 is switched from OFF status to ON status. In concert with the change of status of the upper limit switch 311, the transport controller 601 instructs the lift motor to stop the lift drive. Thus, the elevator plate 203 stops at the appropriate document transporting position, and the document feeder 135 enters the transport standby state until a document supply start instruction is input (S710: YES to S703: NO in FIG. 7). During the time until the status of the upper limit switch 311 changes to ON, the lift drive for the elevator plate 203 from the lift motor 503 is continuous (S710: NO to S709 in FIG. 7). When the projection on the back surface of the elevator plate 203 is removed while the elevator plate 203 is rising, the lower limit switch 312 switches from ON status to OFF status.

On the other hand, when the document stack loaded on the document tray 136 has a number of sheets near the upper limit capacity of the document tray 136, the upper limit switch 311 is turned ON by the change of status of the set switch 603. When the upper limit switch 311 is ON, there is no need for the elevator plate 203 to be lifted. Therefore, the transport controller 601 does not instruct the lift motor 503 to produce a lift drive, and the document feeder 135 is in a transport standby state until a document supply start instruction is input (S702: YES to S703: NO in FIG. 7). In the present embodiment, the preparatory operation controller 602 stores the status of the upper limit switch 311 when a status change is generated in the set switch 603.

When the start button of the copier 101 is pressed in the transport standby state mentioned above, the preparatory operation controller 602 performs a preparatory operation as necessary (S703: YES in FIG. 7). That is, when the elevator plate 203 is not lifted when a document is loaded (S702: YES in FIG. 7), the preparatory operation controller 602 executes a preparatory operation to drive the lift motor 503 in the lifting direction by an amount just equivalent to the backlash (S704: NO to S708 in FIG. 7). When the elevator plate 203 is set at the document loading position, the drive direction of the elevator plate 203 immediately beforehand is the lowering direction. The drive force of the lift motor 503 is not transmitted to the elevator plate 203 until the backlash has dissipated since the drive direction is the reverse of the immediately preceding drive in the initial execution of the lifting drive for the elevator plate 203 after a document stack has been loaded. Thus, when the elevator plate 203 set at the document loading position and receives a lifting drive, the elevator plate lifting operation is delayed and does not start quickly. However, since the gear assembly backlash is dissipated by the preparatory operation in the present embodiment, the elevator plate 203 lifting operation is executed without delay during a subsequent transporting operation. When the preparatory operation is completed, the preparatory operation controller 602 sends a document feeding start instruction to the transport controller 601 (S705 in FIG. 7).

When the elevator plate 203 is lifted while a document is loaded (S702: NO in FIG. 7), the preparatory controller 602 sends a document supply start instruction to the transport controller 601 without executing a preparatory operation (S704: YES to S705 in FIG. 7). In the present embodiment, the preparatory operation is only performed when the upper limit switch 311 is turned OFF while a document stack is loaded on the document tray 136. This arrangement is employed because when the upper limit switch 311 is turned OFF, the backlash is dissipated by the process of lifting the elevator plate 203 to the appropriate transporting position even without executing the preparatory operation.

The transport controller 601, which has received a transport instruction from the preparatory operation controller 602, inputs a drive signal to the feed motor 611 to rotate in the transport direction. When the feed switch 321 detects a document sheet within a predetermined number of drive pulses (set time) after the actuation of the feed motor 611 has started, the transport controller 601 rotates the feed motor 611 in the transport direction a set number of drive pulses after the moment the document sheet has been detected by the feed switch 321, then the feed motor 611 is stopped. The operation causes the document sheet to bend and to press against the resist roller 304. At this time the excitation of the feed motor 611 is maintained.

Next, the transport controller 601 rotates the resist motor 612, transport motor 613, and discharge motor 614 in the transport direction. When the resist switch 322 detects a document sheet within a predetermined set time (drive pulse number) after the drive of the resist motor 612 has started, the transport controller 601 waits until the document sheet is detected by the timing switch 323. When a document detection signal is received from the timing switch 323, the transport controller 601 stops the resist motor 612 when it has been confirmed that the document sheet has passed the resist switch 322 within a predetermined drive pulse number range (transport amount) set according to the size of the document from the time the document sheet was detected. The excitation of the resist motor 612 is maintained at this time.

When the resist motor 612 has stopped and the set switch 603 is ON (document present), the transport controller 601 determines the status of the upper limit switch 311 (S706: YES to S712 in FIG. 7). If the upper limit switch 311 is ON at this time, the transport controller 601 executes document transport without driving the lift motor 503, that is, with the lift motor 503 in the stopped condition (S712: YES to S713 to S705 in FIG. 7). Furthermore, if the upper limit switch 311 is OFF, the transport controller 601 drives the lift motor 503 and lifts the elevator 203 until the upper limit switch 311 is turned ON (S712: NO to S714 in FIG. 7). Then, when the upper limit switch 311 is turned ON, the transport controller 601 stops the lifting of the elevator plate 203 and executes document transport (S712: YES to S713 to S705 in FIG. 7).

Conventionally, when a document is loaded that has a number of sheets near the upper limit capacity of the document tray 136, the elevator plate 203 cannot be raised until the gear assembly 505 backlash has dissipated in the first lifting operation of the elevator plate 203. Thus, not only was time required to raise the elevator plate 203, time was also needed to perform a retry process and time was needed for document transport. Moreover, the lifting operation was recognized as an error in copiers in which an abnormal lift is determined if the upper limit switch 311 is not turned ON within a predetermined time (predetermined number of drive pulses) after the elevator plate 203 has started rising. In contrast, the present embodiment can prevent these faults since the backlash is dissipated by a preparatory operation beforehand.

On the other hand, if the set switch 603 is OFF (document not present) when document passage has been confirmed by the resist switch 322, the transport controller 601 drives the transport motor 613 and discharge motor 614 a predetermined number of drive pulses set according to the size of the document, then turns OFF the excitation of the motors 611, 612, 612, and 614 after the final document has been transported. At the same time, the transport controller 601 drives the lift motor 503 in the lowering direction until the projection on the back surface of the elevator plate 203 has been detected by the lower limit switch 312 (S706: NO to S707 in FIG. 7).

When the lower limit switch 312 detects the elevator plate 203, the transport controller 601 turns OFF the excitation of the lift motor 503.

Although omitted from FIG. 7, the transport controller 601 performs a retry process according to conditions when the document detection status of the feed switch 321, resist switch 322, and timing switch 323 differs from the condition described above. When the normal document transport cannot be accomplished even by a retry process, the transport controller 601 determines a transport error (jam) and stops the document transport operation.

In the embodiment of the document feeder of a copier described above, a backlash in the gears of the drive system is dissipated when a document supply start instruction is input. Therefore, the lifting of the elevator plate is executed without delay during document transport even when a document stack near the upper limit capacity is loaded on the document tray 136. Furthermore, during the elevator plate lifting operation while a document is being transported, there is no time during which a drive force is not transmitted to the elevator plate and transport errors and transport retry processes are reduced. Therefore, an object can be transported reliably in a short time.

Figure 8:
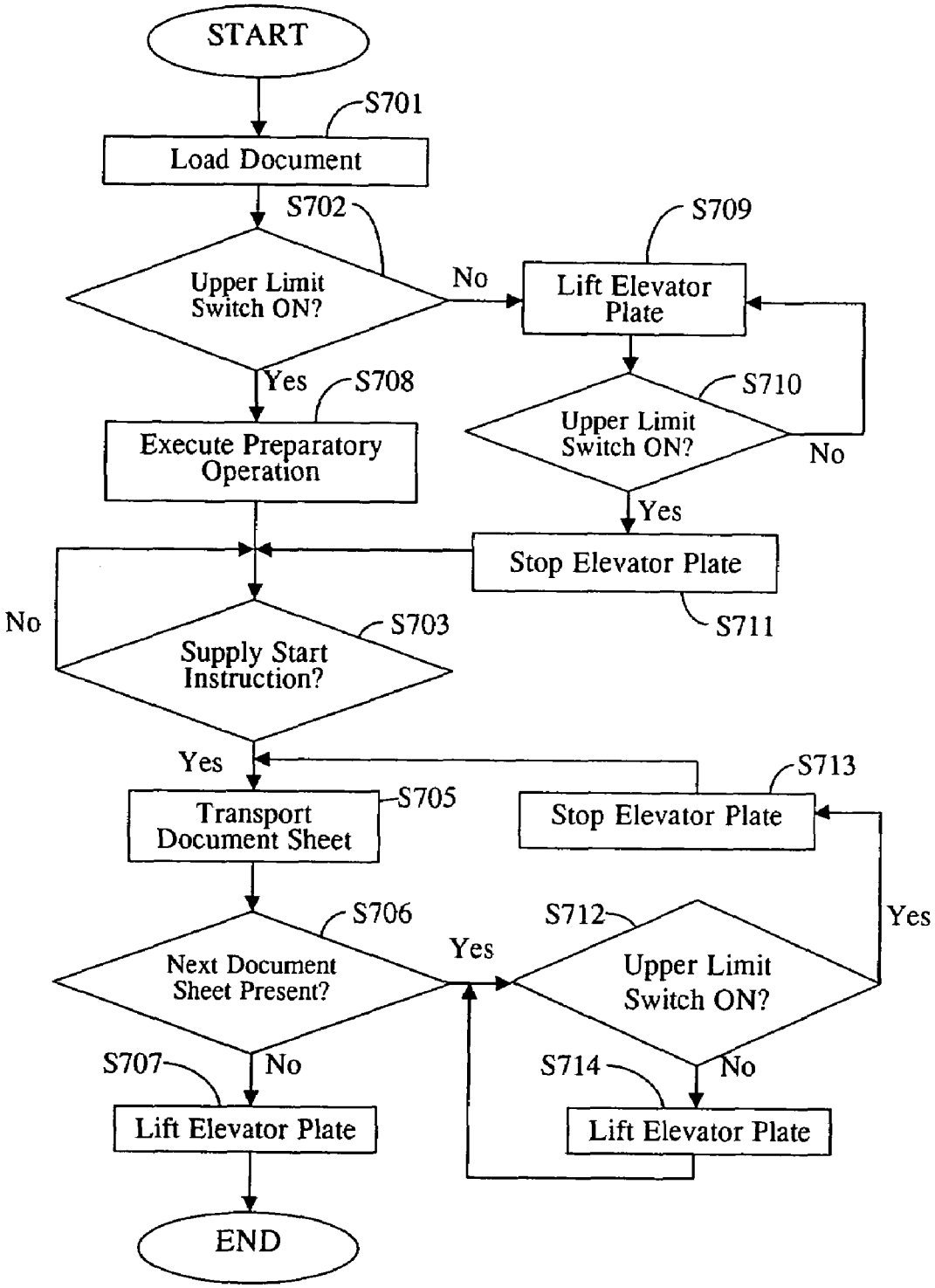
FIG. 8 is a view of a flow chart showing a modification of the process of the document feeding device of the first embodiment of the present invention.

The above description pertains to a configuration that performs a preparatory operation when a supply start instruction has been input. However, the preparatory operation may also be performed prior to the input of the supply start instruction. FIG. 8 is a flow chart showing a modification of the process when a document stack is loaded in the document feeder 135. This modification differs from the flow chart of FIG. 7 only in the timing of the execution of the preparatory operation. In FIG. 8, steps in which processes are performed that are identical to the flow chart of FIG. 7 are identified by identical reference numbers.

In the present embodiment, referring to FIGS. 3, 6, and 8, the preparatory operation is executed immediately by the preparatory operation controller 602 when the upper limit switch 311 is ON when a document stack is loaded on the document tray 136 (S701 to S702: YES to S708 in FIG. 8). When the preparatory operation is completed, the document feeder 135 enters the transport standby state (S703: NO in FIG. 8). Thereafter, the transporting of the document starts in conjunction with a supply start instruction (S703: YES to S705 in FIG. 8).

According to this configuration, the backlash of the gear assembly 505 that causes the faults in the conventional art is dissipated at the moment the document is loaded even when the document that is loaded on the document tray 136 is near the upper limit capacity. Therefore, an effect identical to that of the above configuration can be obtained by performing the preparatory operation at the start of the document supplying process. This configuration further reduces the fast copy time (the time from the depression of the start button until the image of the first sheet of the document has been read) since the preparatory operation is not performed after the document transport instruction has been input. In the case of this configuration, the document transport instruction need not be input to the preparatory operation controller 602, and may be directly input to the transport controller 601.

Figure 9:
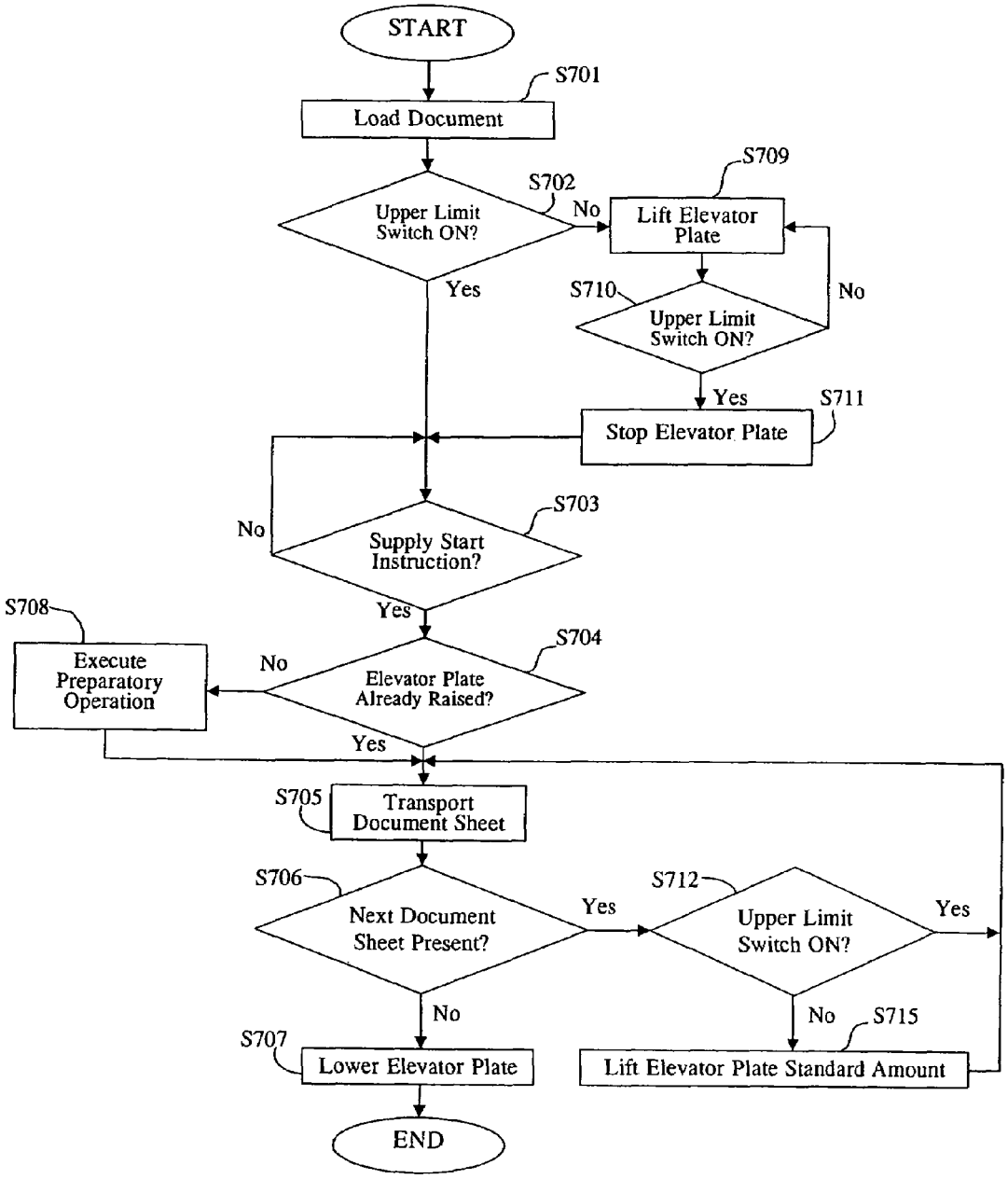
FIG. 9 is a view of a flow chart showing another modification of the process of the document feeding device of the first embodiment of the present invention.

As mentioned above, the stopping position of the elevator plate 203 is detected by the upper limit switch 311 when the elevator plate 203 is raised during document transport. The amount by which the elevator plate 203 is lifted while a document is transported is equivalent to the amount of decrease in the thickness of the document which diminishes as the document is transported. Therefore, the amount by which the elevator plate 203 is lifted while a document is transported can be set at a constant amount. FIG. 9 is a flow chart showing another modification of the process when a document stack is loaded in the document feeder 135. In this modification, only the method of the lift drive for the elevator plate 203 during document transport differs from the flow shown in FIG. 7. In FIG. 9, steps in which processes are performed that are identical to the flow chart of FIG. 7 are identified by identical reference numbers.

Referring to FIGS. 3, 8, and 9, the transport controller 601 determines the presence/absence of a next document sheet when a document sheet is fed from the uppermost position of the document stack as in FIG. 7 (S706 in FIG. 9). When the set switch 603 is turned ON (document present) and the upper limit switch 311 is OFF, the transport controller 601 lifts the elevator plate 203 by only a standard amount (S706: YES to S712: NO to S715 in FIG. 9). The standard amount is the distance separating the top surface of the document stack (appropriate transport position) when the elevator plate 203 has been lifted when a document is loaded, and the top surface of the document stack when the document transport has progressed and the upper limit switch is turned OFF. The standard amount is set beforehand in the transport controller 601. When the lift motor 503 is a stepping motor, this standard amount can be set, for example, as the number of drive pulses of the lift motor 503. When the lifting of the elevator plate 203 is completed, the transport of the next document sheet is performed (S705 in FIG. 9). When the set switch is turned ON and the upper limit switch is ON, the next document sheet is immediately transported (S706: YES to S712: YES to S705 in FIG. 9).

According to this configuration, the elevator plate 203 can be reliably lifted by just a standard amount even by the first lifting operation from the document loading position since the backlash has been dissipated beforehand by the preparatory operation. Therefore, the generation of the faults caused by the backlash of the gear assembly 505 can be reliably prevented. In this modification, the execution of the preparatory operation is not mandatory at the moment the document transport instruction is input. As described in FIG. 8, the preparatory operation may also be executed immediately when the upper limit switch 311 is turned ON when a document is loaded in the document tray 136.

Alternate Embodiments

Alternate embodiments will now be explained. In view of the similarity between the first and alternate embodiments, the parts of the alternate embodiments that are identical to the parts of the first embodiment will be given the same reference numerals as the parts of the first embodiment. Moreover, the descriptions of the parts of the alternate embodiments that are identical to the parts of the first embodiment may be omitted for the sake of brevity.

Second Embodiment

Figure 10:
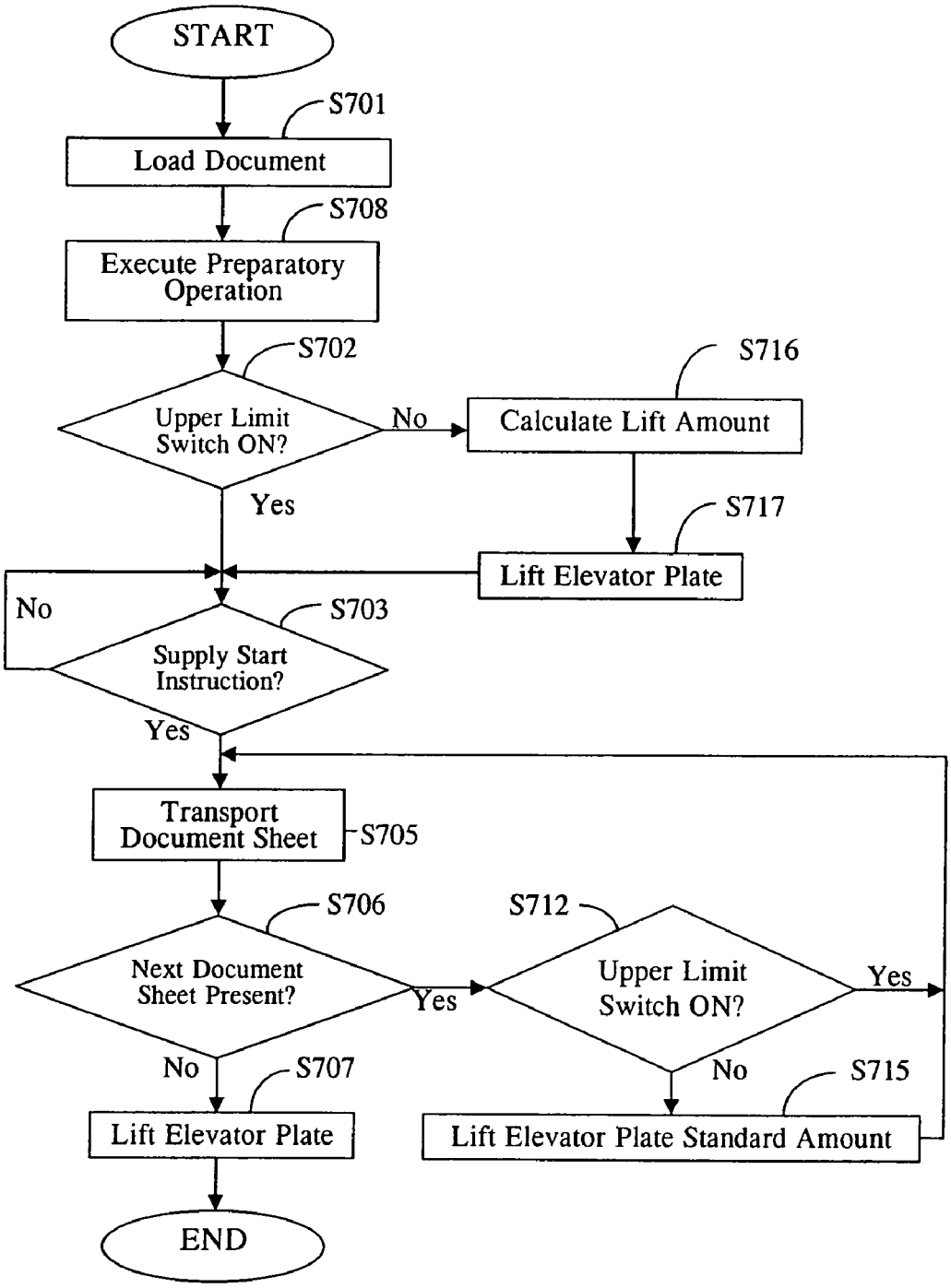
FIG. 10 is a view of a flow chart showing the process of the document feeding device of a second preferred embodiment of the present invention.

In the first embodiment, when the upper limit switch 311 is OFF when a document is loaded on the document tray 136, the elevator plate 203 was lifted until the upper limit switch 311 is turned ON. However, the document feeder 135 may also lift the elevator plate 203 by another method. In the present embodiment, the document feeder 135 is further provided with a document position sensor for directly detecting the position of the top surface of a document stack loaded on the document tray 136. In this configuration a determination is made as to the distance separating the appropriate transport position and the position of the top surface of the document stack detected by the document position sensor. Accordingly, the top surface of the document stack can brought to abut suitably the pick-up roller 301 by lifting the elevator plate 203 just the separation distance when the document stack is loaded. When the lift motor 503 is a stepping motor, the control of the amount of lift can be easily accomplished by setting the number of drive pulses of the stepping motor input to the lift motor to correspond to the distance separating the appropriate transport position and the top surface of the document stack. FIG. 10 is a view of a flow chart showing the process when a document stack is loaded in the document feeder. In FIG. 10, steps in which processes are performed that are identical to the flow chart of FIG. 7 are identified by identical reference numbers.

In the present embodiment, referring to FIGS. 3, 6, and 10, the preparatory operation controller 602 immediately performs the preparatory operation when the a document stack is loaded on the document tray 136 and the set switch 603 is ON. When the preparatory operation is completed, the transport controller 601 determines whether or not the upper limit switch 311 is turned ON (S702 in FIG. 10). When the upper limit switch 311 is ON, the document feeder 135 enters the transport standby state (S702: YES to S703: NO in FIG. 10). Furthermore, when the upper limit switch 311 is OFF, the transport controller 601 calculates the amount by which to lift the elevator plate 203 based on the output signal of the document position sensor (S716 in FIG. 10). The amount of lift can be calculated using only the output signal of the document position sensor because the appropriate transport position is constant without regard to the thickness of the loaded document stack.

The transport controller 601 inputs a lift drive pulse corresponding to the calculated mount of lift to the lift motor 503 based on the calculated amount of lift, and the elevator plate 203 is lifted. In the present embodiment, the backlash of the gear assembly 505 is dissipated by executing the preparatory operation. Therefore, the lifting operation is a lifting operation from the document loading position, and the elevator plate 203 is reliably lifted only the calculated lift amount. The top surface of the document stack suitably abuts the top surface of the pick-up roller 301 via this lift. After the lifting of the elevator plate 203 is completed, the document feeder 135 enters the transport standby state (S703: NO in FIG. 10).

When the start button of the copier 101 is pressed in the transport standby state, a document supply instruction is input to the transport controller 601, and the document transports begins as described previously (S705 in FIG. 10). The transport controller 601 determines the presence/absence of a next document sheet when a document sheet is fed from the uppermost position of the document stack (S706 in FIG. 10). When the set switch 603 is turned ON (document present) and the upper limit switch 311 is OFF at this time, the transport controller 601 lifts the elevator plate 203 by only a standard amount (S706: YES to S712: NO to S715 in FIG. 10). When elevator plate 203 has been lifted the standard amount, the next document sheet is transported (S705 in FIG. 10). Then, when the set switch 603 is turned ON and the upper limit switch is ON, the next document sheet is immediately transported (S706: YES to S712: YES to S705 in FIG. 10).

According to this configuration, the elevator plate 203 can be reliably lifted by just a standard amount even by the first lifting operation from the document loading position since the backlash has been dissipated beforehand by the preparatory operation. Therefore, the generation of the faults caused by the backlash of the gear assembly 505 can be reliably prevented as in the first embodiment.

On the other hand, if the set switch 603 is OFF when the uppermost document sheet of the document stack is fed, the transport controller 601 turns OFF the excitation of the motors 611, 612, 612, and 614 after the document sheet being transported has been discharged. At the same time, the transport controller 601 turns OFF the excitation of the lift motor 503 after the lift motor 503 has been driven in a lowering direction until the lower limit switch 312 turns OFF (S706: NO to S707 in FIG. 10).

In the embodiment of the document feeder of a copier described above, a backlash in the gears of the drive system for the elevator plate is dissipated. Therefore, the elevator plate 203 can be precisely lifted just a standard amount even by the first lifting operation from the document loading position. In this way the top surface of the document stack can be caused to abut suitably the pick-up roller, and a document feeder can be realized that has excellent sheet feeding performance.

The embodiments described above do not limit the technical scope of the present invention inasmuch as the present invention may be variously modified and used in various applications within the scope of the present invention. For example, although the document is lifted by oscillating one end of the elevator plate in the above embodiments, the invention is not limited to this mode. The present invention is also applicable to document feeding devices that lift and lower a document by moving the elevator plate in vertical directions.

Although a preparatory operation is performed based on the detection signals of a set switch and an upper limit switch in the above embodiments, the preparatory operation may also be performed based on the detection signals of an upper limit switch and lower limit switch. That is, the elevator plate is not lifted when a document is loaded if the upper limit switch and the lower limit switch are both turned ON.

Moreover, the preparatory operation controller may also perform the preparatory operation based on the drive direction of the lift motor driven immediately before by the transport controller instead of the detection signals of the set switch and the upper limit switch. Thus, it is possible to determine whether or not the drive direction of the elevator plate after a document has been loaded is the opposite direction to the immediately previous drive direction even when, for example, the document loading position is set at an intermediate part and not at the bottom end of the movable range of the elevator plate. Moreover, the timing by which the preparatory operation controller executes the preparatory operation is optional insofar as the execution occurs within the period from the completion of the drive operation of the elevator plate in one direction by the lift motor to the start of the drive operation of the elevator plate in the other direction.

Although the present invention is realized as a document feeder of a digital copier in the embodiments described above, the present invention is also applicable to sheet feeding devices such as manual trays, and cassette type paper trays such as that shown in FIG. 1. Additionally, the present invention is not limited to digital copiers and can be applied to apparatuses provided with a sheet supplying function such as facsimile machines, scanners, and multifunction apparatuses.

The document feeding device of the above embodiments may also be realized in sheet supplying devices as described below. That is, the sheet supplying device has a configuration provided with an elevator plate mounted to be liftable and lowerable on a sheet loading surface; a drive part to lift the elevator plate via gears; and a part to execute a preparatory operation to operate the drive part in another direction only a drive amount corresponding to the gear backlash during the time after the drive part has completed an elevator plate drive operation in one direction until the start of an elevator plate drive operation in another direction. The sheet supplying device feeds sheet-like members, such as documents, paper sheets bearing a transferred document image and the like, one sheet at a time.

In this sheet supplying device, when an operation is performed that reverses the drive direction (lifting immediately after lowering, lowering immediately after lifting), a drive amount corresponding to the backlash is driven beforehand. Therefore, the elevator plate can be reliably moved a desired lifting or lower amount even when the drive direction is reversed. That is, in this sheet supplying device, the drive gear backlash is dissipated at the moment the sheet supplying starts. Therefore, the lifting of the elevator plate is executed without delay even though the lifting drive of the elevator plate occurs during the time after the document has been loaded and the start of the document transport as in the case in which a document stack is loaded on the document tray that is near the upper limit capacity. Furthermore, during the elevator plate lifting operation while a document is being transported, there is no time during which a drive force is not transmitted to the elevator plate and transport errors and transport retry processes are reduced. Accordingly, this sheet supplying device can transport sheets reliably in a short time.

The sheet supplying device may also be provided with a sheet detecting part to detect the presence/absence of a sheet on an elevator plate. In this configuration, when no sheet is detected, the drive part drives the elevator plate to a sheet loading position at which a sheet can be loaded. The preparatory operation is performed when a new sheet is loaded on the elevator plate at the sheet loading position. The preparatory operation may also be performed when a new sheet is loaded on the elevator plate at the sheet loading position and a sheet supplying start instruction has not been received. According to this configuration, a sheet is reliably supplied even when the loaded sheets are near the upper limit capacity. In addition, the drive for a desired amount of lifting is performed rapidly since there is not a time at which a drive force is not transmitted to the elevator plate during the elevator plate lifting operation.

This sheet supplying device may be further provided with an appropriate position detector to detect an appropriate position to dispose the elevator plate when the sheet transport starts in accordance with the number of sheets loaded on the elevator plate, so that the preparatory operation is then executed only when the sheet loading position is detected as the appropriate position.

This sheet supplying device may be provided with an elevator plate mounted to be liftable and lowerable on a sheet loading surface; a pick-up roller to abut from above a sheet loaded on the elevator plate, and to feed the sheet; a drive part to drive the elevator plate via gears across a sheet loading position to load sheets and an appropriate transport position at which the top surface of the of a loaded sheet abuts the pick-up roller; and an upper limit position sensor to detect whether or not the top surface of the sheet abuts the pick-up roller. The configuration may also be provided with a controller to execute the preparatory operation to operate the drive part in a lifting direction only a drive amount corresponding to the gear backlash when sheet has been loaded at the sheet loading position and the upper limit position sensor has detected that the top surface of the sheet abuts the pick-up roller.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including," "having," and their derivatives. Also, the terms "part," "section," "portion," "member," or "element" when used in the singular can have the dual meaning of a single part or a plurality of parts. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A transporting device for moving an object, comprising:

a loading surface configured to hold and transport the object, the object including at least one sheet;

an elevator plate mounted on the loading surface, the elevator plate being configured to be liftable and lowerable on the loading surface;

a drive part configured to lift the elevator plate via gears in a first direction and to lower the elevator plate via the gears in a second direction opposite the first direction;

a controller configured to execute a preparatory operation to operate the drive part to correspond to a gear backlash in the first direction opposite the second direction, the preparatory operation being operating the drive part during a time after completion of an elevator plate drive operation in the second direction until a start of a continuation of an elevator plate drive operation in the first direction; and an appropriate position detector having an upper limit detector configured to detect the object abutting a pick-up roller signaling an appropriate transport position at which to dispose the elevator plate when starting to transport the object according to the number of sheets of the object loaded on the elevator plate, and a lower limit detector configured to detect that the elevator plate has reached a lower limit, the preparatory operation being executed while the upper limit detector detects the object abutting the pick-up roller.

2. The transporting device of claim 1, further comprising an object detecting part configured to detect the presence or absence of the object on the elevator plate, wherein the drive part drives the elevator plate to an object loading position to load the object when the object detecting part has detected the absence of the object, and the controller executes the preparatory operation when a subsequent object is loaded on the elevator plate at the object loading position.

3. The transporting device of claim 1, further comprising an object detecting part configured to detect the presence or absence of the object on the elevator plate, wherein the drive part drives the elevator plate to an object loading position at which the object is configured to be loaded when the object detecting part has detected the absence of the object, and the controller executes the preparatory operation when a subsequent object is loaded on the elevator plate at the object loading position and an object transport start instruction has been received.

4. An image forming apparatus comprising:

an image reading part; and an image forming part including a transport device having a loading surface configured to hold and transport an object, the object including at least one sheet, an elevator plate mounted on the loading surface, the elevator plate being configured to be liftable and lowerable on the loading surface, a drive part configured to lift the elevator plate via gears in a first direction and to lower the elevator plate via the gears in a second direction opposite the first direction, and a controller configured to execute a preparatory operation to operate the drive part a drive amount corresponding to a gear backlash, the preparatory operation being operating the drive part during a time after completion of an elevator plate drive operation in the second direction until a start of an elevator plate drive operation in the first direction, and an appropriate position detector having an upper limit detector configured to detect the object abutting a pick-up roller signaling an appropriate transport position at which to dispose the elevator plate when starting to transport the object according to the number of sheets of the object loaded on the elevator plate, and a lower limit detector configured to detect that the elevator plate has reached a lower limit, the preparatory operation being executed while the upper limit detector detects the object abutting the pick-up roller.

5. The image forming apparatus of claim 4, wherein the transport device further has an object detecting part configured to detect the presence or absence of an object on the elevator plate, wherein the drive part drives the elevator plate to an object loading position to load the object when the object detecting part has detected the absence of the object, and the controller executes the preparatory operation when a subsequent object is loaded on the elevator plate at the object loading position.

6. The image forming apparatus of claim 4, wherein the transport device further has an object detecting part configured to detect the presence or absence of the object on said elevator plate, wherein the drive part drives the elevator plate to an object loading position at which the object is configured to be loaded when the object detecting part has detected the absence of the object, and the controller executes the preparatory operation when a subsequent object is loaded on the elevator plate at the object loading position and an object transport start instruction has been received.

* * * * *